United States Patent [19]

Strada et al.

[11] Patent Number: 4,523,648

[45] Date of Patent: Jun. 18, 1985

[54] SHEATHED, MULTI-CORE, OIL FILLED, ELECTRIC CABLE WITH OIL DUCT EXTERIOR TO THE CORES

[75] Inventors: Francesco Strada, Scaldasole; Giuseppe Bazzi, Milan, both of Italy

[73] Assignee: Societa Cavi Pirelli S.p.A., Milan, Italy

[21] Appl. No.: 578,411

[22] Filed: Feb. 9, 1984

[30] Foreign Application Priority Data

Feb. 14, 1983 [IT] Italy ..... 19572 A/83

[51] Int. Cl.[3] ..... H01B 9/06

[52] U.S. Cl. ..... 174/26 R; 174/15 C; 174/25 R

[58] Field of Search ..... 174/25 R, 26 R, 15 C

[56] References Cited

U.S. PATENT DOCUMENTS

| | | | |
|---|---|---|---|
| Re. 28,425 | 5/1975 | Priaroggia et al. | 174/15 C |
| 1,710,845 | 4/1929 | Simons | 174/26 R |
| 2,006,932 | 7/1935 | Rosch | 174/25 R |
| 2,102,129 | 12/1937 | Rosch | 174/25 R |
| 2,457,436 | 12/1948 | Bennett | 174/15 C |
| 2,498,494 | 2/1950 | Hickernell | 174/26 R |
| 3,211,821 | 10/1965 | Wakefield | 174/26 R |
| 3,949,154 | 4/1976 | Rasquin | 174/15 C |

FOREIGN PATENT DOCUMENTS

| | | | |
|---|---|---|---|
| 673914 | 11/1963 | Canada | 174/25 R |
| 1494 | 4/1979 | Japan | 174/25 R |
| 94327 | 12/1959 | Netherlands | 174/26 R |

*Primary Examiner*—A. T. Grimley
*Assistant Examiner*—Morris H. Nimmo
*Attorney, Agent, or Firm*—Brooks Haidt Haffner & Delahunty

[57] ABSTRACT

An electric cable having a fluid-tight, metal sheath containing a plurality of cores without oil ducts, each including a conductor surrounded by insulation, and a separate tubular member adjacent and contacting two of the cores and having an oil duct of a cross-sectional area at least equal to the cross-sectional area of the sum of the oil duct cross-sectional areas normally included in each core. The spaces between the tubular member and the cores and between the cores, the tubular member and the sheath are filled with an insulating filler, and the insulation of the cores and the filler are impregnated with an insulating oil and the duct of the tubular member is filled with the insulating oil. The sheath contacts the outer surfaces of the tubular member and the cores, and the oil duct of the tubular member contains a plurality of longitudinally spaced, oil flow restrictors.

10 Claims, 2 Drawing Figures

SHEATHED, MULTI-CORE, OIL FILLED, ELECTRIC CABLE WITH OIL DUCT EXTERIOR TO THE CORES

The present invention relates to a multi-core, oil-filled cable and more particularly, to a multi-core oil-filled cable to be used as submarine cable.

The known multi-core oil-filled cables comprise a fluid-tight metal sheath enclosing a plurality of cores, each core being constituted by a conductor covered with an insulation impregnated with insulating, fluid oil, fillers interposed in the stellar spaces of the sheath which also is impregnated with insulating, fluid oil, and a plurality of ducts of small diameter, for the movement of the oil in longitudinal direction of the cable, embedded in said fillers.

In the known multi-core oil-filled cables, each oil duct is constituted by a cylindrical helicoid formed by a wound metal tape, the turns of which are spaced from one another. Outside the metal sheath, there also are coverings and mechanical reinforcing structures as the lapped or longitudinal armors.

The known multi-core oil-filled cables, the structure of which has been briefly described, can present some drawbacks especially, when used as submarine cables.

First of all, they are not satisfactorily able to withstand the impacts of foreign bodies which can take place on the installed cable, for example, through the action of anchors or fishing nets, because of the inadequate support of the metal sheath by the cores and of the oil ducts. This makes it necessary, where possible, to take recourse to safety measures, such as, to lay the submarine cable under the sea bed in the zones where the risk of impacts on the cables by the foreign bodies is greater, but these safety measures cannot always be used, such as, for example, in case of laying the cable on rocky bottoms, and are not always efficacious.

Another drawback of the known multi-core, oil-filled cables and in particular, of those used as submarine cables, consists in the difficulty encountered by the insulating, fluid oil of moving along the cable and, more specifically, in the oil ducts of the cable. Usually, a multi-core submarine cable is constituted by a very long length, and the known ones have a plurality of oil ducts of small diameter. Therefore, the losses of pressure in the movement of the oil within the cable reach unavoidably high values, not only owing to the long length of the oil ducts, but also mainly owing to the small diameters of the oil ducts.

Such effects make it necessary to use high pressures in the cable hydraulic circuit of the insulating, fluid oil, and the greater the losses of pressure in the cable oil ducts are, the higher said pressures must be. The presence of high pressures of the insulating, fluid oil within the cable requires the use of armor, resistant to the pressure action, around the cable sheath, the higher the oil pressure within the cable is, the stronger said armor must be.

A further drawback, especially in the case of multi-core, oil-filled submarine cables, is that in the presence of ruptures occuring in the metal sheath, there are very great leakages of fluid oil, and this causes unacceptable pollution of the surrounding ambient and requires a continuous feeding of the cable with great quantities of fluid oil up to the time the cable is repaired in order to avoid penetration of water into the cable thereby damaging the cable.

One object of the present invention is to overcome the drawbacks of the known multi-core, oil-filled cables mentioned hereinbefore.

Another object of the present invention is to provide a multi-core, oil-filled cable comprising a plurality of cores, each core being constituted by a conductor covered with an insulation impregnated with insulating oil, each core being tangent to at least one adjacent core and to the metal sheath enclosing said cores, characterized by the fact that said cable also comprises a tubular body, for the longitudinal movements of the oil, arranged inside said sheath and tangent to it and to two of said cores, said tubular body having an outer diameter of the same order as that of said cores.

According to a preferred embodiment of the present invention, said tubular body has a radial deformability less than or equal to that of the sheath.

According to a further preferred embodiment of the present invention, said tubular body is constituted by a keystone-shaped, tubular, metallic structure or a metallic wire structure, preferably, of aluminum.

Other objects and advantages of the present invention will be apparent from the following detailed description of the presently preferred embodiments thereof, which description should be considered in conjunction with the accompanying drawings in which:

FIGS. 1 and 2 represent sections of the part of a three-core cable constituting an embodiment of a multi-core, oil-filled cable of the present invention, but FIGS. 1 and 2 do not illustrate the usual coverings, lappings and longitudinal armors which are put around the sheath of a cable and which are of the type known per se.

Figure 1:
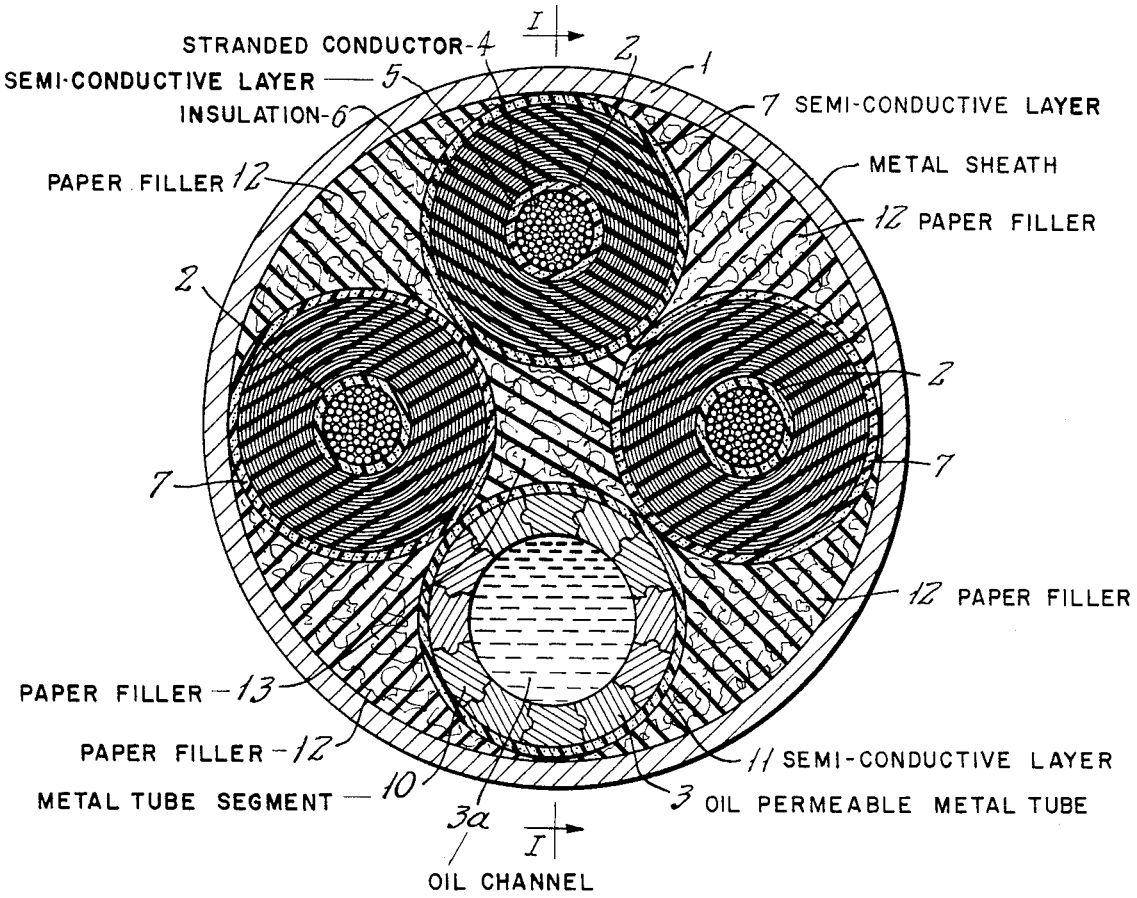
FIG. 1 shows, in transverse section, a view of the multi-core, oil-filled submarine cable according to the present invention the outer covering for the metal sheath being omitted.
Figure 2:
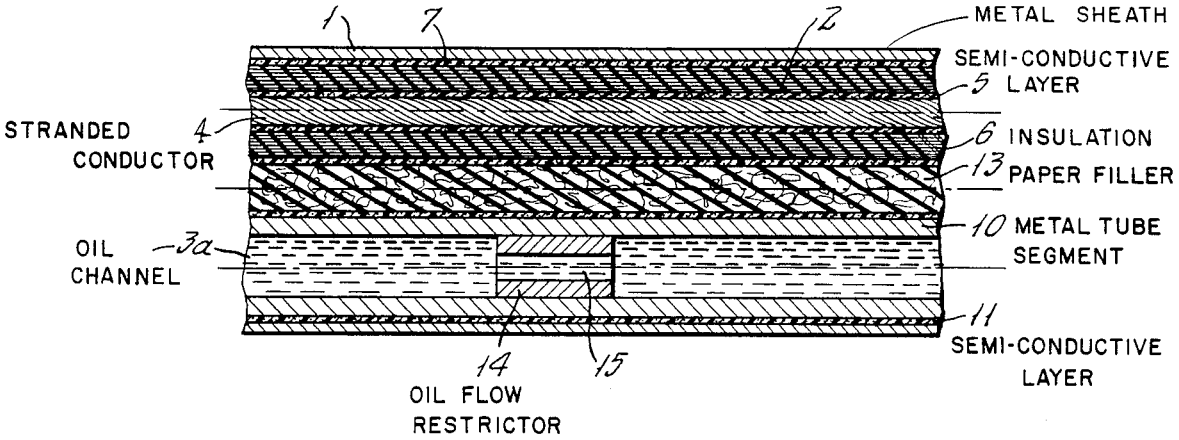
FIG. 2 shows, in reduced scale, a longitudinal section view taken along the line I—I shown in FIG. 1.

As shown in FIGS. 1 and 2, within the fluid-tight metal sheath 1, for example, of lead or aluminum, there are three conductors 2 and a tubular body 3. Each conductor 2 is constituted by a plurality of metallic wires 4, for example, of copper, laid-up together, and each has therearound, a semi-conductive layer 5 constituted by a plurality of windings of tape of a semi-conductive material, for example, of carbon paper.

Around the semi-conductive layer 5 of each conductor 2, there is provided insulation 6, formed by a plurality of windings of paper tapes of cellulose or synthetic material, and upon the insulation 6, there is a semi-conductive covering 7 also formed by a plurality of windings of a semi-conductive tape, for example, carbon paper. The assembly of conductors 2, conductive layers 5 and 7 and insulation 6 is commonly called a "core". The insulation 6, the semi-conductive layers 5, 7 and 11 and the tubular body 3 are permeable by the insulating oil.

The tubular body 3, constituting the oil duct of the cable, is placed in contact with the semi-conductive coverings 7 of two adjacent conductors 2, i.e. with tangent exterior surfaces. Both the tubular body 3 and all the cable cores having tangent surfaces also have their surfaces tangent to the interior surface of the cable metal sheath 1, and said tubular body 3 has a radial deformability than or equal to that of the cable metal sheath. The manner by which this property is conferred to said tubular body 3 can be attained, in a known manner, through suitable thicknesses, materials or structures.

The central oil channel 3*a* of the tubular body 3 is, as a rule, of the same cross-sectional area as the sum of the cross-sectional areas of three oil channels of the ducts of the known three-core cables.

The tubular body 3 is preferably constituted by a tubular structure formed by a bundle of a plurality of keystone-shaped, metal elements, preferably, of aluminum, each element 10 interlocking with the adjacent elements 10, and is, preferably, covered with a semi-conductive layer 11 formed by a plurality of windings of semi-conductive tape, for example, of carbon paper. In this case, the tubular body 3 is in physical and electrically conductive contact with the cable sheath 1 through the semi-conductive layer 11.

More particularly, each keystone-shaped, metal element 10 has, in cross-section, the shape of an isosceles trapezoid and has a groove on one side of the trapezoidal shape and a protuberance on the other side of the trapezoidal shape.

The shape and the dimensions of the grooves and of the protuberances present on the sides of each keystone-shaped element 10 are such as to be able to engage in a fixed way, respectively, with the protuberances and with the grooves present on the keystone-shaped elements 10 adjacent to said keystone-shaped element 10.

According to an alternative embodiment (not illustrated), the tubular body 3 is constituted by a structure formed by a plurality of wires of aluminum, which is, preferably, covered with a semi-conductive layer 11 formed by a plurality of semi-conductive tape windings.

The tubular body 3, provided with the semi-conductive covering 11, has, generally, an outer diameter of the same order of magnitude as that of the cores and preferably, has an outer diameter equal to the outer diameter of the outer surface of the semi-conductive coverings 7 of the cores.

In the stellar spaces existing between the metal sheath 1 and the semi-conductive screens 7 and 11, there are the fillers 12 of insulating material, preferably, of paper. Moreover, also in the stellar space between the semi-conductive layers 7 and 11, there is a filler 13 of insulating material, for example, of paper. The fillers 12 and 13 are of a known type and may, for example, be shaped blocks which are obtained by doubling up a plurality of cellulose paper tapes and which are oil permeable.

In the whole space enclosed within the sheath 1 there is an insulating oil of type known per se, such as, for example, an alkylbenzene, which impregnates the insulation 6 of the conductors 2, the fillers 12 and 13 and the oil channel 3*a* of the tubular body 3 which constitutes the oil duct of the cable.

Within the channel 3*a* of the tubular body 3, there are preferably present means for reducing the cross-sectional areas at points spaced from one another along the length of the cable to restrict the flow of oil in the duct 3*a*. FIG. 2 represents a particular embodiment of means for reducing the area of the oil channel 3*a* of the tubular body 3 constituting the oil duct of the cable at points spaced from one another.

As shown in FIG. 2, the means for reducing the area of the channel 3*a* of the tubular body 3 comprises a plurality of spaced, oil-flow restrictors (only one of which is shown in FIG. 2), each having the shape of a small, hollow cylinder 14 provided with a through opening 15 of a diameter smaller than the diameter of the channel 3*a*. In particular, as an area reducing body 14 for the duct of a cable, according to the present invention, the body described in Italian Pat. No. 962,363, assigned to the assignee of the present application, is particularly suitable. The body 14 is held in place by reason of the friction between the exterior surface of the body 14 and the interior surface of the channel 3*a*.

From the foregoing description of a particular embodiment of a multi-core, oil-filled cable according to the present invention and from the following explanations, it is easily understood that by means of said construction, the objectives of the invention are achieved.

A multi-core, oil-filled cable according to the present invention is mechanically stronger with respect to the effects of the impact actions to which it may be subjected, especially, when it is used as submarine cable, since in a cable according to the present invention the metal sheath 1 is internally supported at more points with respect to the known cables.

In fact, in a cable according to the present invention, the metal sheath 1 is in contact not only with the coverings of the conductors 2, which are practically indeformable under the impact action, as compared to the deformability of the fillers contained in the stellar spaces under the impact action, but also with the tubular body 3 which provides the oil duct 3*a* and which presents a smaller, or at most equal, radial deformability than that of the sheath.

Moreover, in case of impacts which may cause the rupture of the metal sheath 1, a cable according to the present invention is able to limit greatly the insulating, fluid oil leakages with respect to the known cables. In fact, also in the case in which, besides the rupture of the sheath, there takes place a squashing of the tubular body 3, its keystone-shaped tubular structure may become deformed, but the elements 10 tend to remain in contact with one another so that the oil outflow is made more difficult.

It is obviously impossible to achieve this result with the known multi-core cables, because in said known cables, the oil duct is defined by a helicoid of a shaped member where the adjacent turns are spaced from one another.

Moreover, a multi-core cable according to the present invention, with respect to the known ones, has a hydraulic circuit for the insulating fluid oil which operates better. This due to the fact of providing a single duct having a large diameter for the movement of the oil instead of three distinct ducts, each of small diameter as in the known multi-core cables. In fact, the losses of pressure due to the movement of the insulating fluid oil within a conduit, are inversely proportional to the fourth power of the diameter of the conduit itself, and therefore, it is understandable that the drawings which can be obtained is in reductions of losses of pressure with the increase of the diameter of the oil duct.

Moreover, because of the fact that the oil duct of a multi-core cable according to the present invention has an inner surface which is smoother than that of the oil ducts of the known multi-core cables, there is a further reduction of the losses of pressure.

Finally, by means of a multi-core, oil-filled cable according to the present invention, especially if it is used as submarine cable, there is obtained a great safety against the propagation of water into the inside of the cable and more particularly, within the cable oil duct in case of rupture. In fact, in the oil duct 3*a* of a cable according to the present invention there are provided at positions spaced from one another, means 14 intended to reduce the area of the duct. Said means 14 are not provided in the known multi-core cables, which provide oil ducts constituted by helicoids of a shaped member, embedded in the fillers of the cable core.

Although preferred embodiments of the present invention have been described and illustrated, it will be apparent to those skilled in the art that various modifications may be made without departing from the principles of the invention.

The embodiments of the invention in which an exclusive property or privilege is claimed are defined as follows:

1. A multi-core, oil-filled, electric cable comprising:

a tubular metal sheath;

a plurality of cores arranged in side-by-side relation within said sheath with the outer surfaces of said cores contacting the inner surface of said sheath and with the outer surface of each core contacting the outer surface of at least one adjacent core, each said core comprising a conductor covered by insulation impregnated with and permeable to an insulating oil; and a tubular body within said sheath and contacting the inner surface of said sheath and the outer surfaces of at least two of said cores, said body having an inner, longitudinally extending, oil conduit and being oil permeable to permit oil to flow from said conduit to said insulation and vice-versa and said body having an outer diameter of the same order in size as the outer diameter of one of said cores and having a resistance to radial deformation at least equal to the resistance of said sheath to radial deformation.

2. A multi-core, oil-filled, electric cable as set forth in claim 1 wherein said tubular body is formed by a plurality of metal elements in side-by-side relation.

3. A multi-core, oil-filled, electric cable as set forth in claim 2 wherein said metal elements are a plurality of keystone shaped metal elements in contacting and side-by-side relation.

4. A multi-core, oil-filled, electric cable as set forth in claim 3 wherein said elements are made of aluminum.

5. A multi-core, oil-filled, electric cable as set forth in claim 2 wherein said tubular body is covered with a winding of a tape of semi-conductive material.

6. A multi-core, oil-filled, electric cable as set forth in claim 5 wherein each of said cores is covered with a winding of a tape of semi-conductive material.

7. A multi-core, oil-filled, electric cable as set forth in claim 1 wherein the cross-sectional area of said conduit is reduced in size at longitudinally spaced points as compared to the cross-sectional area of said conduit intermediate said points.

8. A multi-core, oil-filled, electric cable as set forth in claim 7 wherein the cross-sectional area of said conduit is reduced at said points by the presence of tubes, one at each of said points, each tube having a bore smaller than the size of the conduit intermediate said points.

9. A multi-core, oil-filled, electric cable as set forth in claim 1 wherein there are three cores, each core and said tubular body having an outer, semi-conductive layer, one core being in contact with two other cores and the two other cores being in contact with said tubular body.

10. A multi-core, oil-filled, electric cable as set forth in claim 9 wherein there are spaces between the cores and the tubular body and between the cores and the tubular body, on the one hand, and the sheath, on the other hand, and wherein said spaces are filled with oil permeable insulation.

* * * * *